US009202344B1

(12) United States Patent
Pao

(10) Patent No.: US 9,202,344 B1
(45) Date of Patent: Dec. 1, 2015

(54) PAIR 9 POKER PLUS

(71) Applicant: LiChen Pao, Egg Harbor Township, NJ (US)

(72) Inventor: LiChen Pao, Egg Harbor Township, NJ (US)

( * ) Notice: Subject to any disclaimer, the term of this patent is extended or adjusted under 35 U.S.C. 154(b) by 0 days.

(21) Appl. No.: 14/816,095

(22) Filed: Aug. 3, 2015

Related U.S. Application Data

(63) Continuation-in-part of application No. 13/552,825, filed on Jul. 19, 2012, now abandoned.

(51) Int. Cl.
*G07F 17/32* (2006.01)

(52) U.S. Cl.
CPC ..... *G07F 17/3293* (2013.01); *G07F 17/3225* (2013.01)

(58) Field of Classification Search
CPC . G07F 17/322; G07F 17/3244; G07F 17/326; G07F 17/3262; G07F 17/3272; G07F 17/3288; G07F 17/3293
See application file for complete search history.

(56) References Cited

U.S. PATENT DOCUMENTS

2009/0102127 A1* 4/2009 Marchesani ..... A63F 3/00157 273/292

* cited by examiner

*Primary Examiner* — Tramar Harper
*Assistant Examiner* — Jeffrey Wong
(74) *Attorney, Agent, or Firm* — Cameron LLP

(57) ABSTRACT

Pair 9 Poker Plus is a card game wherein a five card hand is dealt and a single card discard made such that a first and a second two card hand remains of the selected four cards to be held by a player. Wagers and payouts in physical items are provided for which may be electronic, currency or virtual currency that are validated, and, if accepted, establish credit for game play and are likewise utilized for payout. The first two card hand is ranked according to poker and so a pair of aces is high and the second two card hand is ranked according to baccarat rules where a ten, jack, queen or king are zero, the tens digit of the sum of two cards is not part of a point value and so a nine is the highest ranking hand by point value. A virtual dealer uses artificial intelligence from memory stored game rules to make a choice of discard and first and second two card hands to play.

20 Claims, 5 Drawing Sheets

INSURANCE

| | |
|---|---|
| 4 Unmatched Picture Cards 1-2 High | 100-1 |
| 4 Unmatched Picture Cards 1-3 High | 80-1 |
| 4 Unmatched Picture Cards 1-6 High | 50-1 |
| 3 Unmatched Picture Cards 1-3 High | 30-1 |
| 3 Unmatched Picture Cards 1-6 High | 10-1 |
| 2 Cards Unmatched with 1-5 High | 5-1 |
| Any Suited 5 Card Straight 10-J-Q-K-A ("THE ROYAL UNO") | |

FIG. 1B

Bonus Jackpot

| | |
|---|---|
| 5 9s Diamond | Jackpot |
| ANY 5 of a Kind | |
| ANY 4 of a Kind | |
| ANY Full House | |
| ANY 3 of a Kind | |
| 2 Pair | |
| 1 Pair - Point 9 | |
| Point-9 Point-9 | |
| TIE - Front or Back-8-1 | |

FIG. 1C

| HAND | RANK |
|---|---|
| PAIR Aces | 1 |
| Kings | 2 |
| Queens | 3 |
| Jacks | 4 |
| Tens | 5 |
| Nines | 6 |
| Eights | 7 |
| Sevens | 8 |
| Sixes | 9 |
| Fives | 10 |
| Fours | 11 |
| Threes | 12 |
| Twos | 13 |
| SUM: 9 | 14 |
| 8 | 15 |
| 7 | 16 |
| 6 | 17 |
| 5 | 18 |
| 4 | 19 |
| 3 | 20 |
| 2 | 21 |
| 1 | 22 |
| 0 | 23 |

Hand Ranking Table

FIG. 2

HOW TO PLAY THE GAME

PAIR 9 POKER PLUS

This application is a continuation-in-part patent application which claims the benefit of priority to U.S. patent application Ser. No. 13/552,825 filed Jul. 19, 2012 of the same title and the same inventor.

BACKGROUND OF THE INVENTION

1. Field of the Invention

The present invention has to do with, and relates to, the general field of casino gaming, more particularly, to the table play of games of chance, including games in the genre of poker, and the present invention is, likewise, within that genre. The game that is the subject of this patent application may also be obtained in some or other form of electronic, computer play, commonly called virtual or electronic video poker, or played on a telecommunications device or computer via the world-wide web as a video game player. And so the present game in electronic form is also subsumed by, under, and within the scope of this application.

2. Background

The present invention and patent application concern advances in the science of game design, to wit: aspects of poker in combination with aspects of baccarat. This invention in its embodiments are new, and unique, and original to the inventor. These various embodiments of the invention are perceived to offer unique features that are (1) both exciting and attractive to players of table, virtual world and video gaming apparatus, and (2) profitable for a gaming establishment and casino operators, and, at the same time, address and resolve the shortcomings of other casino pokers and related games played at tables or played on electronic apparatus. Of course, the present game may be played for recreational and other purposes besides any gambling purpose and so may be fun and recreational for players to play. Players, such as would play a conventional video game, may play for score and, by the score, win the opportunity to play the game again and again.

Poker is one of the most popular games on the planet. Poker lends itself to play in a wagering/betting environment because the play of poker per se is almost entirely dependent upon the deal from, in almost all cases, a single, standard deck of playing cards (a standard deck of 52 cards). The present invention may preserve the "primacy of the deal" and the play of and from a standard deck of cards, and the hands of cards so dealt, while using a single deck. However, the use of multiple decks, for example, six to eight decks of cards, including complete decks, and/or complete and partial decks, in the course of play, is included within and covered by the scope of this invention, in table and or electronic play, for fun or as a casino game.

With specific regard to poker—being one of the oldest and most popular games in the United States—this game has an established gambling aspect to it that allows a player to wager that he or she holds a poker hand that is higher in rank than the hand or hands held by the dealer at the play table and/or, at the same time, other player(s) in the same game. Almost all poker games feature a five card hand, and the player holding the highest ranking hand is usually the declared winner of any game. The usual and ordinary pre-established poker hand rankings from high to low, are as follows:

ROYAL FLUSH, being Ace, King, Queen, Jack and Ten of the same suit

STRAIGHT FLUSH, being any five cards in a sequence of the same suit

FOUR OF A KIND, aces being the highest and four deuces, the lowest

FULL HOUSE, being three of a kind and a pair (being two of a kind), where a winner is established based first on the highest ranking being three aces and a high pair of kings FLUSH, being five cards in the same hand of the same suit where the cards are ranked by spades the highest and clubs the lowest in the event of a tie in high card of the flush STRAIGHT, being five cards in a sequence but all or some of different suits THREE OF A KIND, being three cards of the same rank, like three aces TWO PAIR, being set of two cards alike ONE PAIR, being two cards of the same rank NO PAIR, being nada, nothing, Ace high being the highest ranking of NO PAIR Any or all of the above pre-established poker hands in the above ranking, can, for a variety of game design reasons, be broken down into sub-sets, including such things as hands with high pairs, middle value pairs, and/or low pairs. The same would apply to other hands, such as high straights or low straights, etc. In this same regard, suits such as Spade, Heart, Diamond, and Club already have a traditional ranking between them. With the use of such sub-sets, other and further hand rankings are made possible in any game, and, of course, the present invention finds general application and each and all of these possibilities.

Card and hand values, then, include a ranking order, per the above, which is standard in the play of poker per se, and, in addition, card and hand values, similar to card value ranking of a baccarat hand. This type of ranking includes what can be called, for want of a better word, a point value, the same being especially useful in the determination of a winning hand absent the presence of some commonly obtained hand ranking, all as set forth above, for a high pair such as a pair of Aces. Point values for purpose of this invention follow the face value or point value of that presented by each card, for instance, a 3 has and is assigned a point value of 3. Face cards, in turn, have and are assigned a value of 0, the same for a ten, and Aces play as and are assigned a point value of 1. This scoring follows aspects of the game of baccarat where a two card hand is evaluated by the sum of the values of the cards of the hand. Its sum score total point value, may be, for example, 17, and the first or ten's digit is not included in the value. So a 17 becomes a 7 value, for example, for a 9, 8 two card hand. For example, a hand of a king and queen is evaluated as 0, 0 or 0 total. The most desirable hand is one totaling 9 or may be represented by a 6, 3 or 2, 7, a jack, 9 or other combination reaching 9 without the initial ten's digit. For example, a 6, 9 is evaluated as 5. Card and hand ranking and, in turn, point values, per the above, are utilized in the present invention in the evaluation of hands, comparison of competing hands, and the determination of winning hand(s) according to a predetermined ranking as will be discussed with reference to FIG. 2.

In that the player, as mentioned above, may be playing against the dealer, if not also against other players at a table, both, or against a machine computer processor logic generated hand, all possibilities thereof are within the scope of this invention. The player is actually playing to win with the cards dealt to him or her in each hand of play, and the higher the poker hand ranking/hand ranking by point value achieved by the player, relative to the competition, the more often the player may win. So, in addition to evaluating the hand value of the player per se, in all hands wherein the player wins, he or she may win a designated value in the form of a payout, award, jackpot, bonus, and/or anything else of value such as a score and by the score an opportunity to play the game again provided for by the rules of the play, all of the same subject to being the same and or different, depending upon the venues of play. Also, depending upon the design application of the game, any and all forms of a winning hand can be rewarded in any manner, or scale, or multiplier of any and all wagers or bets placed by the player on his or her hand or hands, and/or may be paid in accordance with a posted table card or pay table stored in machine memory wherein there may be enumerated winning hands and winning hand values, per any applicable pay table, based upon the number or value of chips, coins, tokens, tickets or credits (money), in the usual course, relative to the amount of the bet, wagered by the player.

For games played for money, for example, at a gaming table or by machine, such as the present Pair 9 Poker Plus game played at a machine or casino gaming table, inventory manager-chip kiosks are known, for example, from U. S. Published Patent Application 2007/0060307, whereby chips representing currency may be dispensed in response to receipt of currency, credit card, debit card, bank account transmittal and the like. The kiosk may comprise, for example, a screen display, a touch pad or keypad data input, a chip reader, a ticket validator, an automatic teller capability for credit or debit and connect to the internet, Ethernet, or to various communication devices, electronic or optical to provide casino items of monetary value for play and items of monetary value for payout. The dispenser may stack chips (or other physical items as described below) on receipt and dispense the chips to a user or a single ticket having monetary value. Near field communication (NFC) transaction terminals will soon be available to accept chips, tokens, tickets, credit and debit cards, and the like representing money electronically stored in mobile intelligent devices. The kiosk may use ATM protocols as well as NFC to receive or dispense physical items as defined below. Apple Pay and Google Wallet are examples of apps on cell phones that are ever improving NFC apps for intelligent phones. One communicates with a casino wager or payout device including a slot machine and can play electronically via credit, debit transactions through stored credit cards. Other devices known in the art include CashIO ticket redemption kiosks, tickets at table games (TITA) for ticket redemption and issuance at table games, for example, available from Apogee Electronic Services Inc., micro card redemption and charging devices and management software for managing such kiosks and devices. Another known provider of payment processing, cash handling and cash management services for casinos is NRT Technology Corp. of Ontario, Canada which uses the brands QuickJack, QuickTouch kiosk and QuickTable cash management. Cruise ships offer credit card/debit card storage and electronic play at cruise ship casinos. While some casinos operate on a strict cash basis, others prefer casino tokens, gaming chips, checks or cheques or tickets. Physical item, as used in the specification and claims, may be defined as a validated token, chip, check, ticket, electronic, stored credit/debit card or other casino accepted form of payment or payout having monetary value in both physical and electronic form as dispensed or received, for example, via near field communication between an equipped intelligent mobile device and a so-equipped transaction terminal, radio frequency communication, via the internet, via an Ethernet or hand delivery or validated receipt. One physical item as defined typically has a monetary value of, for example, one dollar US but may have a similar value in another currency such as one Euro. Moreover, a payout may be in the form of a ticket of a value of fractional currency such as a payout from a conventional slot machine, for example, in quarter dollar US amounts and so fractional physical items as defined exist.

Also, a casino game may be simply played for fun. For example, a known smart telephone or small pad computer provides a keyboard with sufficient numerical, functional and alphabetic keys and typically a touch-screen to permit a player at a remote terminal to play a game for fun with a remote machine special-purpose computer. The game may run as an application on the device after downloading from a server as is known in the art.

In all of the above regarding this invention, its scope, likewise includes game play, table lay out or electronic interface, whereby the player may play one or more hands in the same game, without limitation in either a live, electronic or virtual form of play. Each hand so played may include one or more hands or sub-hands, and or any such hand and or sub-hand, likewise, may be subject to wagering in physical items as defined above and scoring and score accumulation, as described further herein.

Further to the above, upon completion of any hand or hands played, in table, virtual or electronic apparatus play of the game subject to this invention, any and all payouts, awards, jackpots, bonuses, and the like, may be paid in physical items as defined above or just be fun to the player and/or to the player and others in any sort of a community pay out or community pot (such as a virtual or imaginary pot), and the same is also subject to and included within the scope of this invention.

There are at present various popular forms of casino poker, for table and electronic play; however, there is no game like the game that is the subject of this invention, which will be referred to herein as Pair 9 Poker Plus. Pair 9 Poker Plus may be described as a combination of aspects of poker and baccarat in scoring and may have, for example, the similarity to poker of an initially dealt or displayed five card hand. With brief reference to FIG. 2, a first two card hand may be a pair of aces and a second two card hand selected from a five card draw hand with discard of a pair of kings and thus may win both hands when compared with a dealer or other players, the hands being ranked 1 and 2.

For clarity, it should be remarked that table games as referenced herein are usually played on 'felt', dealt by a live dealer, with a live player or players at the table. Electronic video poker is today played on machines, virtual games on a smart telecommunications device or special game apparatus. Conventional electronic poker may involve a typically metal or other solid cabinet and a video display terminal (VDT screen), usually a touch screen input device, and or deck of buttons (key board) to actuate play, and, within the terminal, a special purpose microprocessor of some sort that operates the varied features of the machine, from play to record keeping in memory, and the like. In a virtual sense, a player may play Pair 9 Poker Plus using an electronic communications device with a remote machine.

In the usual course of play, a player inputs his or her wager, for example, in one or more physical items, and initiates play, whereupon a specially program microprocessor following rules of play selects at random from stored memory a digital representation of five cards that become the player's hand and may be displayed on an output device such as a display or, if table play, the five card hand may be dealt face down to a player on a table per FIG. 1. This computer memory normally represents and includes each of the cards of a single, standard deck of playing cards, being fifty-two cards, not counting jokers or may represent a random draw from a simulated multiple card deck of six to eight decks. This "drawn" hand is displayed on the VDT of a machine or a telecommunications device to the player and, presumably, is not known to the machine virtual player or dealer. The present invention intends to and may include any future use of a robotic or some new form of electronic form of what is now known as table play such as play on a hand held telecommunications device.

For historical perspective, the most popular form of poker has been DRAW poker games (instead of stud poker games) that deal to a player the customary five card hand from a single standard deck of fifty-two playing cards. In this regard, it must be mentioned that there are DRAW poker games on the scene that deliver to the player more cards in the form of one or more hands, for the same single wager and or for separate wagers on each hand, for example, in physical items as defined above and, again, all cards are dealt from a single, standard deck of fifty-two cards. In DRAW poker, the player is dealt five cards, and the player selects one to five of the said cards to hold, discarding any unwanted cards, to be replaced from the said deck during play. Winning or losing DRAW poker hands is determined by comparing the player's final hand to the pre-established poker hand pay table. A very typical pay table for electronic video poker is as follows:

The following payouts may be awarded in physical items as defined above in a scenario of a bonus bet B in Pair 9 Poker Plus and are conventional five card poker awards after a five card deal. Awards per One Coin, Token, Credit of Money, or Monetary Unit or other physical item or items wagered or Played:

| | |
|---|---|
| NADA (No Pair) | Zero |
| ONE PAIR (Or often a pair of a designated rank, such as Jacks or Better) | One |
| TWO PAIR | Two |
| THREE OF A KIND | Three |
| STRAIGHT | Four |
| FLUSH | Six |
| FULL HOUSE | Nine |
| FOUR OF A KIND | Twenty-five |
| STRAIGHT FLUSH | Fifty |
| ROYAL FLUSH | Two hundred fifty—PER CREDIT BET |

It should here be noted that, in addition to the above, some known poker games involve "Wild Cards", whereby one or more ranked cards, such as Deuces, Jokers, one-eyed face cards or other cards, are played as wild. A player may use wild cards to match other cards in the deck in poker and/or these games will pay with one or two jokers that are provided with every new deck of playing cards, and, if jokers are in play, they usually play as "wild" in hands wherein there are Aces, Straights, or Flushes, and or some other final outcome. Likewise, poker games can involve the use of one or more Jokers, playing by the usual and/or different rules in any game.

The present invention covers any and all of these applications, including hand rankings by poker count and by baccarat count, and the like, "wild" cards, and or "joker" in the play of the subject game. A deuce's wild game or one eyed face card in the present invention may be scored in ranking a two card baccarat hand as a 2-7 or other predetermined card value according to house rules and so achieve a 9, fourteenth ranked hand. A joker may be similarly valued in ranking or may be any value desired by the machine, dealer or player. A wild card dealt or displayed to a player of the present game will typically use the wild card to make a highest ranked hand such as a pair of queens rather than a fourteenth ranked 9 baccarat hand.

In the poker genre, there are two poker games that utilize differing numbers of cards in addition to the various DRAW and STUD configurations, including Indian Poker, using one card, Aces—Deuces, using two cards, plus one, Three Card Poker, Four Card Poker, Five Card Poker, Six or Bonus Card Poker, even Seven Card Poker, and super poker, using ten cards. In that it is possible to imagine configurations of the game subject to this invention in table, robotic table, virtual and/or electronic play, even with differing numbers of players, and hands played, as well as the number of cards in each hand, subject to a draw or no draw (as in Stud play) any and all of these variations are likewise included within the scope of this invention.

By way of further and related background, the following is included for reference: In recent years, multiple hand DRAW poker has become popular in the electronic video poker format. One such game is known as "Pick One Poker", and is described in U.S. Pat. No. 5,816,915. This game deals the player four separate five card hands of poker from a single deck after the player has placed his or her wager, for example, in one or more physical items as defined above, and, then, the player selects which one of the four five card hands to play. Also, the most popular version of multiple hand DRAW poker is known as "Triple Play Poker", and is described in U.S. Pat. No. 5,823,873, and elsewhere (U.S. Pat. Nos. 5,531,448; and 6,007,066). In this game, as it is described, the player places a separate bet on each of three hands. All cards, including the first hand, are dealt from a single, standard deck of playing cards. After the first hand is dealt, face up, the player then selects none, one, two, three, four or five cards thereof to hold, discarding the rest. The held cards are, then, duplicated into the other two hands of poker on the video screen, and replacement cards are dealt for all the non-selected cards in the first hand, and the remaining, additional cards are dealt into the other two hands, all from the same deck, so all three hands have five cards in each. The player then plays the draw hands and is paid any winnings for any of the winning poker hands among the three based upon the customary, pre-established poker pay table. It should be noted that in U.S. Pat. No. 6,132,311, the multi-bet requirement mentioned above was depicted as a drawback to the game per se. It should be noted here that for purposes of the present inventions, the nature of the game played, be it poker, draw poker, stud poker, and or multi-hand poker, the wagering thereon, bet levels, wins and pays per se, for example, in physical items as defined above are not controlling vis a vis the invention, but will instead be seen to be but variables that do not otherwise affect the underlying value and application of the invention to overall poker play. The present invention thus pertains to and has application in any and all of the mentioned poker formats, and, for that matter any and all other poker formats.

By way of still further example in this very regard, there are literally thousands of "Bonus Pokers", and so-called "Second Chance" pokers, like six card poker, and such, and, again, the related predecessor and present inventions will be seen to pertain to, and to have application in, any and all of the same. In fact these game play variables will be seen to have no impact on the invention. Instead, the present invention will be seen to affect and improve upon all of these pokers as games being dealt from a deal of a deck of cards, or, for example, six to eight multiple decks of cards.

As can be readily discerned from the above discussion, all poker games, and, in fact, even Bingo, Lotto, blackjack, baccarat and Keno, depend upon the deal. And, as has been repeatedly mentioned, in poker, this deal has heretofore been from but one single, "standard" deck of playing cards (except blackjack and baccarat). Poker, in a sense, may be wed to the single, "standard" deck of playing cards because the deal therefrom is the heart of the game, and the game, being a game of both chance and skill, requires uniformity in the deck and the rules played. Players expect and may demand no less. Witness the following:

a. In U.S. Pat. No. 6,007,066, Electronic Video Poker Games, Detailed Description of the Preferred Embodiments, paragraph 2: "A conventional deck of fifty-two cards is used".
b. In U.S. Patent No. 2002/0132657 A1, Mirror Image Poker, Summary of Invention, paragraph 1: "The game is played with a single, conventional 52 card deck or with a computer simulation of such a deck."
c. U.S. Pat. No. 6,471,587, B1, Game Method and Device, Background, paragraph 5: "The processor selects from data stored in memory representing each card of a deck of cards, e.g. the fifty-two cards of a standard deck of card." (Note, the Inventor of the present invention disputes the validity of U.S. Pat. No. 6,471,587.)
d. U.S. Pat. No. 5,531,441, Double Poker, Background of the Invention, paragraph 3: "The forerunner of all electronic video poker gaming machines is the video Draw Poker machine that deals cards from a standard 52 card poker deck and displays a single five card hand to the player."

Many more poker patents could be described and cited herein. However, it would be redundant, the point having been already made, to wit: poker per se, as a game both of both chance and skill, is defined by and dependent upon the deal, being a deal from the single, well-known, and accepted "standard" deck of playing cards. This is the foundation of the poker game and its overall popularity—it is fundamental to the game that players know as poker, with the caveat that multiple decks and or multiple complete and partial decks may also be utilized in the play of all poker, including the game that is the subject of this invention where six to eight multiple decks may be utilized because the present game is not really poker but comprises aspects of poker and baccarat and other card games as well.

A Problem with Casino Poker and Electronic Poker: Approximately 42% of Pay-Outs are Even Money or Result in Low Score to a Player for Fun.

There are real and intrinsic drawbacks and related limitations in any and all of the aforesaid games of poker including player's hand only poker as played in either or both the table and electronic video poker or video game environment. These drawbacks and the resultant limitations are a function of the play of single deck poker (even whilst using multiple, single decks), and the mathematical limitations thereby imposed on the game, its betting, and related betting strategy/reward structures. Simply put, there are no large jackpots or scores possible in the play, and, at the same time, the win frequency is not high in comparison to other casino games, and in the play of poker per se, there is a plethora of common low pay/even money pay winning hands and, at the same time, a shortage of higher paying, winning hands, all of this being a function of poker, the deck, its configuration, and the standard card values and hand values, per the above.

Baccarat is played at high monetary stakes. It is a popular casino game due to the relatively even odds with a house or dealer and because one may wager many points or credits or chips or equivalent wagers defined as physical items herein, each having, for example, a unitary monetary value such as $1.00(US). It is known that in baccarat games that a minimum bet may be as much as twenty-five dollars and a maximum bet may be placed and be permitted by "high rollers" on the order of $10,000 (US) in physical items. Also, baccarat is played with typically five to eight decks of cards dealt from a shoe which may be passed from player to player.

It is one object of the present invention to resolve the aforesaid and related shortcomings in the play of poker and to combine exciting scoring aspects of baccarat into a single game by and with the Pair 9 Poker Plus game that is the subject of this invention.

SUMMARY OF THE INVENTION

The present invention extends, expands, and teaches new, and gambler-attractive, fun player attractive variant embodiments of a new game method and apparatus and computer program product for the play of any sort of table, virtual or robotic table game with table or electronic poker aspects and baccarat aspects. This contemplates a new game method for the play of the game, a new configuration of table on which a Pair 9 Poker Plus game is played and a new machine or computer program product playable on a special purpose computer server or hand-held terminal but with the same typical deck of fifty-two cards, and not a special deck, although wild cards are permitted depending on choice of game rules.

As has already been mentioned in the above, the game that is the subject of this invention can be played in live table, robotic table, virtual or electronic configuration, between a dealer or special purpose machine and a single or multiple players, all competing with the dealer or machine per se, according to the rules of the same (or played against the machine as a virtual house or dealer). In another configuration, the same game can be played, under the same or different rules, between any number of players, at the same table, and or at some sort of electronic virtual table, local or wide area via telecommunications (this latter point applies to any and all forms of this game played in any electronic configuration) whereby the players compete against each other in an attempt to win the pay outs, awards, jackpots, or 'pots' in play with a 'pot' being defined as that pool of credits bet/value bet by the participating players, taken all together, and available for award in physical item(s) as defined above or for just plain fun of the game to the designated winner of any hand played which may, for example, result in a game score and a number of free plays depending on the score (as in a conventional pinball machine form of play).

The present invention of Pair 9 Poker Plus game and associated apparatus, exemplary table configuration and the like will be discussed with reference to the drawings, a brief description of which follows.

BRIEF DESCRIPTION OF THE DRAWINGS

FIG. 1B is a table directed to the insurance wager; and FIG. 1C is a table directed to the bonus jackpot wager, all, in physical items as defined above.

FIG. 2 is a drawing of exemplary hand rankings by card type and by point value according to an embodiment of Pair 9 Poker Plus.

DETAILED DESCRIPTION

Figure 1A:
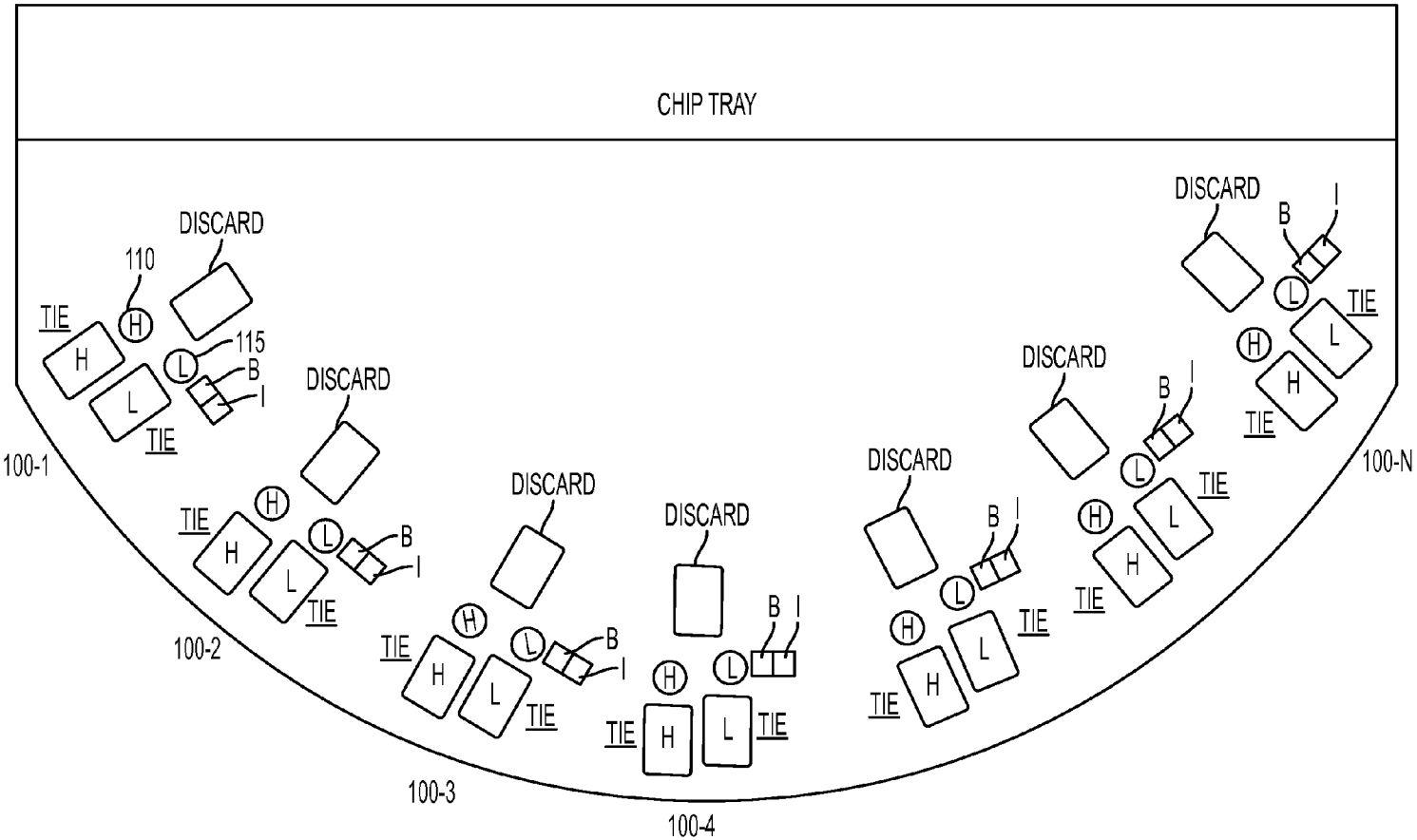
FIG. 1A is a drawing of a typical exemplary table configuration for Pair 9 Poker Plus further showing the concepts of an insurance wager and a bonus jackpot wager with each player configuration similar to configuration 100-1.

Pair 9 Poker Plus will now be discussed with reference to FIGS. 1-4. In order to play the game, each and all players, in whatever format the game is being played, may be required to place a wager, being a 'place bet' on the hand to be played. This place bet may be a virtual value entered via a keyboard of an electronic device. An example board configuration which may be a felt table top is shown in FIG. 1A. In FIG. 1A, for each player configuration 100-1, 100-2, 100-3, 100-4 to 100-N, there is an H or Hi hand location, an L or Lo card hand location, an H circular bet or wager location 110, an L or Lo hand bet or wager location 115, a B or bonus location and an I or insurance bet location. Insurance I wagers are shown in tabular form in FIG. 1B while Bonus Jackpot wagers are shown in tabular form in FIG. 1C, all such wagers, for example, being in physical items as defined above. The Hi hand will be referred to herein as a back hand and the Lo hand will be referred to herein as a fore hand—the names not being mandatory but exemplary only.

The place bet is more like a wager or virtual wager set by a player before and in order to play the game and does not need a special location, but portions or all of the place bet may be moved to one of other the identified location as Pair 9 Poker Plus play progresses. As defined above, the place bet may be in validated physical item(s) wagered, for example, electronically or physically in physical items validated and accepted by the given casino. As will be discussed herein, a predetermined betting structure may be part of the house rules, for example, for a predetermined allocation that may not be exceeded between back and for hands, for example, 2 to 1. In other words, when a player is dealt a pair of Aces and a low-ranking baccarat hand after discard, the player may be prevented by house rules of placing all their place bet on the pair of Aces, ranked number 1. In one embodiment, a player may wager an additional wager on their best ranked two card hand, such as a pair of aces, but the maximum may be set, for example, at 100% of the allowed wager according to the betting structure and, moreover, will return only a certain percentage of the extra wager such as less than or equal to 50%. If a pair of kings is defeated by a dealer or machine or other player pair of aces, the whole wager including extra wager, for example, in physical items as defined above is lost by the player. The so-called place bet is made at the commencement of play of the hand before any cards are dealt or displayed in a video format (display) and may be allocated after the player makes their decisions on first and second hands to play according to the betting structure and any permitted extra wager, all such wagers being in physical items as defined above.

In the game that is the subject of this invention, any player betting on the hand is dealt five cards (per hand). The deal of the five cards in a hand can be done in any of the various possible ways, from dealing all the cards to the player at once, or one by one, going from one player to the next, until all cards are delivered, and or in, in any such manner, dealing the player any number of cards, for instance two cards, followed by one, two, or three more, until all five cards are delivered to each participating player. Similarly, the five card hand may be displayed to a player on a machine or electronic communications device in a similar manner. Participation in play of a hand is determined by the making of the 'place bet' or any other indication by a player that they wish to play a hand, for example, in a simple virtual game played for fun.

Figure 3:
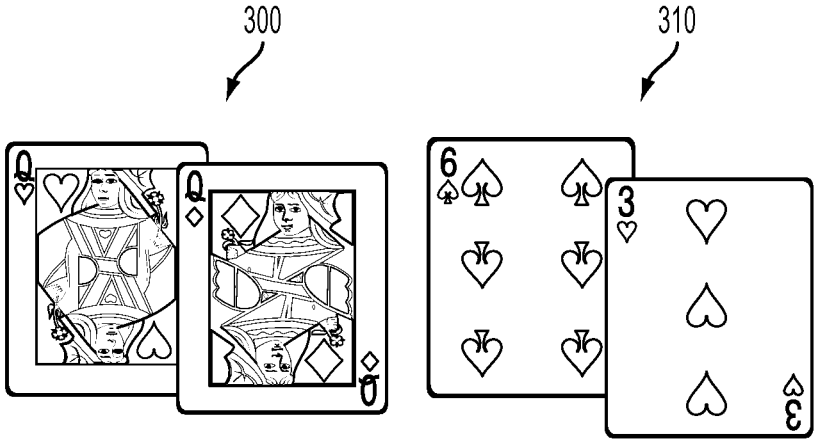
FIG. 3 is a drawing showing an example of a Hi and Lo card breakdown after a discard of a single card, where, for example, a pair of queens may be a Hi hand and the cards 6 of spades and 3 of hearts may be a Lo hand.

As has been already mentioned, each hand played by the player can include one or more hands per se, and, in a preferred embodiment, the player receiving five total cards is perceived to actually be playing two hands or sub-hands, two cards each, depending on how one likes to view the game. And, in this circumstance, the player is playing these two hands as a 'front hand' and a 'back hand', or in other words, a 'low hand', for example, being the 'front hand', and a 'high hand', being the 'back hand.' In FIG. 1 or in a related machine display, the player may be required to choose a single card discard from the five card hand dealt of displayed and place a selected single card in the discard location of their player position 100 such as first player location 100-1. In a machine or electronic device, this discard may be selected and/or made by a cursor (such as by drag and drop) or other input device. Referring briefly to FIG. 3, let us take the example of a player receiving or having displayed before him a five card hand as follows: queen of hearts, three of hearts, queen of diamonds, two of spades and six of spades. A player may choose to play the pair of queens as a Hi hand or back hand in location H, discard the deuce in DISCARD and play the six/three in Lo hand location L of FIG. 1. According to FIG. 2, the player has a first two card hand ranked third and a second two card hand ranked fourteenth.

The player's place bet in advance of the deal can be one such bet, divided between the said hand in any proportion, according to a predetermined betting structure and/or can be two separate and distinct bets, of any value, one relative to the other in circular positions H and L of player position 100 of FIG. 1. An infinite number of possibilities obtain concerning the two bets, one relative to the other, for example, the bets could be of equal value, higher or lower, one to the other, one a multiple of the other, etc. in physical items as defined above. For simplicity purposes, in the ordinary course of play of the game in one embodiment, these two bets are envisioned to be equal or nearly equal, and according to a predetermined betting structure such as in a ratio of 1 to 2, or 2 to 1, or 3, or 4, or 2 to 4, or 3 to 4, or 5, and the like, without limitation (but, possibly, within a permitted betting structure depending on house rules). Also, as explained above, an extra bet may be permitted of a monetary value in physical items, outside the place bet, equal to a percentage of the place bet allocated. For example, a player takes 10 of his place bet and bets on a back hand and adds 10 as an extra bet but may only win based on 10 of the place bet and a reduced percentage such as 50% of his extra bet.

The play of the game that is the subject of this invention also provides for other bets in physical items as defined above at the outset of each hand to be played by any player including but not limited to a bonus bet, an insurance bet and an Ante:

A) A Bonus Bet, for example, at betting location B, FIG. 1, player location 100, and the amount of wager, for example, in physical items on any such Bonus Bet is flexible, being any percentage of the place bet, and winning the bonus bet would provide the player some sort of pay out, award, jackpot, or other bonus pay relevant to the amount of the Bonus Bet, with the manner and sort of bonus pay out actually being nearly infinite. For instance, the Bonus Bet could win and pay whether or not the player wins either or both of the sub-hands H and L in play, and, upon so winning could pay, again, anything of value or fun or machine play credits, from a multiple of the amount wagered on the Bonus Bet to whatever any future game designer might place in a pay table of possible pay outs, from, say, a large pay out for Any or a particular 5 matching, suited cards, and/or 5 matching cards to a simple one 1 pair of cards, and or other point total, and or, likewise, could award a pay out of any sort in the event of a tie between one or both of the player's hands and that of the dealer and or any other player(s). For example, a Bonus bet may be on the original five card hand before discard achieving two pairs in poker. Per the above typical scale, two pairs may result in a payout of double, (2) times, a Bonus bet B. An example of such a Bonus Jackpot pay table is set out on FIG. 1, as attached hereto, being an overview of a sample table 'felt' or table play configuration, at Bonus Bet location B.

B) Any sort of 'Insurance Bet' at location I of FIG. 1 in physical items whereby the player wagers any amount relative to his place bet that he or she may be dealt in the hand to be played one or two losing sub-hands, meaning a losing hand, and the insurance provided by the making of this bet may insure the player against any such loss in the manner including but not limited to erasing or reducing any loss the player would otherwise suffer and/or awarding to the player some other sort of winning pay out, and, in this latter regard, again, an example of such an Insurance payout is set out on FIG. 1, as attached hereto at location I of player position 100. For example, an insurance bet may be a bet before a hand is dealt where the player suspects that they will receive a poor hand such as a king, ten, 2, 3, jack—no poker pairs and no high baccarat score—the best ranking being for a 5 or eighteenth ranking according to FIG. 2. The bet I may be by poker hand or by baccarat hand after five cards are dealt or after first and second two card hands and discard are selected by the player.

C) Any sort of Ante or supplemental bet in the form of physical items as defined above to qualify for the play of the game, with the Ante to be won, lost, or push on a hand by hand basis, depending upon any rules applied to the game in this regard by future game designers or computer implemented instructions. Once the said bets where the place bets are the combination of ante, insurance and bonus are in place, and before the completion of play of the hands of the players participating, any and all Bonus Bet and or Insurance Bets are evaluated and winners determined, for receipt of pay outs, per the rules of the game, all as alluded to above. In another variation of the game and associated special purpose computer apparatus, this evaluation and determination and pay out can be completed at the end of the play of the hands of the players participating instead at the outset of the play of the hands. For example, the insurance bet I may be placed in advance of a hand that the player's hand will be the worst hand five card hand and/or two card hand dealt in terms of poker valuation or score in view of Poker/baccarat valuation, score or FIG. 2 or like ranking figure.

With regard to the play of the hands of the players participating, the following obtains:

In the usual course of play, the player in receipt of his or her five cards, dealt face down (as all cards in the play of this game are dealt face down) or displayed in a video or virtual version, collects and reviews the cards. Then, a player of either table Pair 9 Poker Plus or video or virtual Pair 9 Poker Plus may select and discard one of the cards as DISCARD, retaining four others, to be divided up by the player, two cards each, to the two first and second sub-hands (or hand) in play, being the 'Back hand' or H and the 'Fore hand' or L, with the caveat that the player by the rules of the game that is the subject of this invention must place the 'high hand' in the 'Back hand' and the 'low hand' in the 'Front hand', if such terms are used, all as evaluated by the hand ranking and point methodology expressed in the above and according, for example, to FIG. 2. For example, the player may have a pair of nines, ranked sixth and a baccarat hand of 9 ranked fourteenth as the first and second two card hands after discard and these are compared with a dealer or machine selection of first and second two card hands and/or other player first and second two card hands to determine who wins which hand and a combined score or their own wager depending on the form of play.

In a variation of a Pair 9 Poker Plus game that is the subject of this invention, upon making the aforesaid discard at DISCARD (FIG. 1), the player may, in one embodiment, receive a new Draw card, to thereby return the player to possession of five cards, from which, he or she, in turn, must discard one further card and, then, arrange and configure his or her two hands being the 'front hand' and the 'back hand' at H and L. In another variation, this Draw card could be optional and/or subject to purchase by the player at some pre-set or predetermined amount or value or arrangement with the dealer or virtual or video poker machine, depending upon the rules of the game as envisioned by the game designer according to the present invention as herein described. The dealer or machine may take a similar additional card after discard or not. If not, then, the payouts or awards may be significantly reduced.

After the player has evaluated his cards, and arranged his final two hands, two cards, each, and all players participating have done the same, (in a video poker game, the player may be playing against the special purpose machine), then, the dealer or machine does the same for his/its cards, subject to any and all house (or computer instructions) rules that may apply to this process. There may be an almost infinite number of house rule alternatives to the arrangement of the dealer's cards, and all the same are subject to and subsumed within the scope of this invention.

Once all players and the dealer or machine have completed their respective evaluations and arrangements of their hands into Hi, Lo and discard, then, all cards are revealed to all players and the dealer, in any order found to be convenient by the parties to play, and, upon such revelation, the cards of the hands and all hands per se are compared between the player and the dealer, and the highest hands are declared the winner. To be clear, the highest hands among the 'Back hands' or Hi hands are usually determined first, but alternatively could be determined last, and among the 'Front hands' or La hands. All winners are paid, for example, in physical items and all losers' bets are collected (machine coinage or credit collected), again, in accordance with the rules of the game. In a preferred embodiment of this invention, any and all winners of the 'place bets' are deemed paid at a rate of 1 to 1. However, any other pay out, more or less, is likewise included within the scope of this invention.

In FIG. 2, as attached hereto, there is set forth a table of Hand Rankings, by rank and points, as an example only, of how winners in all of this regard are in the final analysis determined and paid for their two card back and fore hands. From a review of the same, it is obvious that a high pair may be the highest possible winning hand (pair of aces) whereas a 0 0 hand evaluated at 0 is the lowest (for example a King, 10. The cards 10, jack, queen and king are evaluated at 0. The sum of cards such as an 8 and 9 being 17, the ten's digit is disregarded and the two card hand is evaluated at 7 and ranked sixteenth in relation to another player or dealer/machine.

There is in addition to the above, other aspects of the play of the game, in various configurations, that can include, for example, awards or pay outs, monetary or otherwise, or instance, free plays in virtual or machine gaming, and the like, for any sort of winner or loser, including even poor hand 0 0 in the form of, for example, an insurance bet, whereby a player holding, again, for example, a losing 0 0 hand, evaluated at 0 could be awarded something of value, for example, in physical items—especially if they make such an Insurance Bet I on receiving a poor five card hand or a poor two card hand.

In the evaluation and determination of all winners and losers, per the above, there is of course the possibility of Ties, being hands of equal value, and, in the play of the game, that may also be the subject of this invention. Ties may be deemed in Pair 9 Poker Plus to 'push', meaning there is no declared winner or loser, and any and all bets placed on the hand may stand, and stay, in play until the next hand to be dealt. For example, a dealer and a player may, by coincidence, both have a pair of queens—especially playing with multiple decks where even the ranking of spades over hearts over diamonds over clubs may have no winning meaning. With regard to any and all other bets on the same hand, including Ante, Insurance, and Bonus Bets, they too can be allowed to Stand and or, in the alternative, they can be said to be lost by the player (in the event of a tie with another player or especially a dealer) depending upon the particular rules of the game in place at the time and place of play or machine computer instructions in that there is flexibility in this regard and, again, a number of alternative configurations, all of which being within the scope of this invention.

At the same time, if the hands in competition are determined to be Exact Copies (for example, a queen of hearts and a queen of diamonds are shared by two would be winners), then, the player may lose such a hand to a dealer, and the dealer will win, when the player is playing against the dealer or a machine, and, in this regard, the house wins, as the dealer is seen to represent the house in the play of the game.

In another variation of Pair 9 Poker Plus that is the subject of this invention, and again within the scope of the invention per se, with regard to Ties (same score per FIG. 2), as the player participating has both the 'Front hand' and 'Back hand' in play, a different rule could obtain in the play and outcome of the game whereby a player may lose any and all Tie hands, unless, for example, and for example purposes only, the player Ties both of his aforementioned hands and or wins at least one thereof. An example of a tie may be where both dealer or machine and player have a score of 9.

One embodiment of the Pair 9 Poker Plus game subject to this invention as well as other configurations of the same may also include mechanisms for betting and winning at other levels of play of the game, all being within the scope of this invention, including but not limited to the likes of the following: reward to player(s) winning not just one but both hands, and or winning X number of hands played consecutively (where X may be an even value greater than two hands), and or winning both hands in play of any hand with the same or even the exact same hand ranking/value. Again, physical items as defined may be automatically wagered, collected (if the wager is lost) or dispensed in a pay-out.

Figure 4:
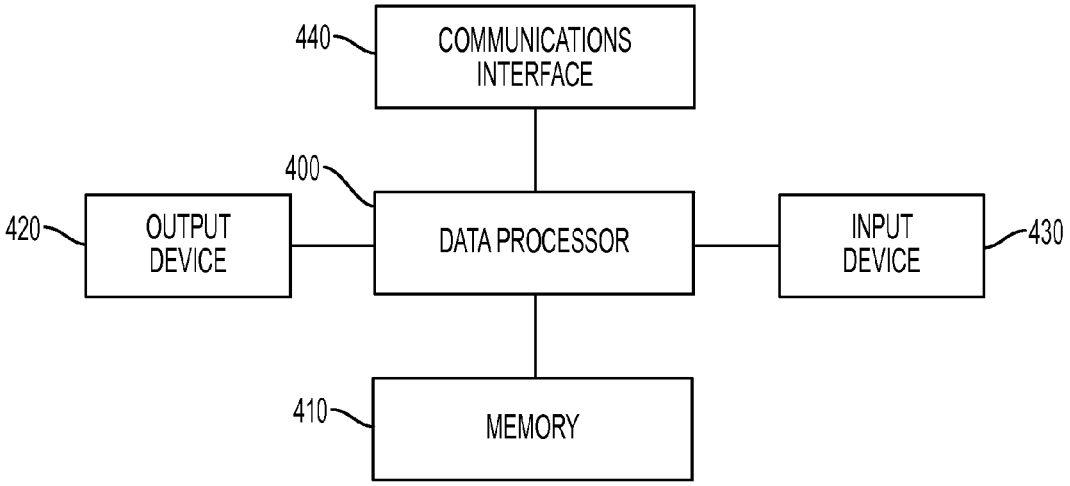
FIG. 4 is an example of a block schematic diagram of exemplary gaming apparatus for playing Pair 9 Poker Plus consisting of a processor, memory, communications device, and input and output devices.

FIG. 4 is an exemplary block schematic diagram of a Pair 9 Poker Plus apparatus or system for permitting play of Pair 9 Poker Plus, providing odds calculations, if necessary, accepting inputs such as wagers and the like in physical items as defined above and outputting displays of the game called Pair 9 Poker Plus, making pay-offs in physical items and providing other outputs and accepting discard commands and inputs for selecting two card hands from a five card hand as back and fore hands. Element 400 may be a data processor well known in the art or a programmed array specially programmed in accordance with known video poker games and/or further providing a Pair 9 Poker Plus game adapted for play as a video poker or virtual hand-held telecommunications game. The system may be implemented in any form such as a personal computer, personal data assistant, intelligent wireless mobile telephone, tablet computer or other device programmed for Pair 9 Poker Plus. Processor 400 is coupled to memory 410 for storing a computer implemented method of operation and rules of play in the form of computer-implemented instructions or sequences of computer code of the auxiliary Pair 9 Poker Plus game per FIGS. 1-3 and descriptions of game play. Processor 400 may utilize known artificial intelligence methods of applying the game rules to make decisions such as discards and first and second hands to play applying such stored rules to advantage of matching or playing in a superior manner to a player. Memory 410 may contain, for example, short term memory of wagers made, cards dealt, hands selected, discards made and game forms selected and the like and long term memory for computer programs, downloads of same and the like. Memory 410 may also receive and store calculated pay-offs received from processor 400 or via a query via communications interface 440. Communications interface 440 may be equipped with GPS and/or with automatic number identification and/or with near field communication of physical items. The system may thus determine if the terminal is within a region where gambling and wagering is permitted, or the game is played for, for example, fun or for game play credits or a score as well as with physical items. The calculated pay-offs offered, play credits, scores, hands won and the like may be output via a display 420 (not shown) of output device 420 which may print out tickets, credits, chips, checks, tokens and the like, any physical item payout, for example, automatically. Output device 420 may be utilized in Pair 9 Poker Plus to make pay-outs to players in physical items via a selected manner of receipt as described above into the player's several accounts, if permitted. (More than one player may play at a given machine or telecommunications device, for example, equipped with near field transaction communication). Input device 430 may be a touch-screen display for accepting Pair 9 Poker Plus commands from a player such as discard and betting, a touch screen or keys or positions per FIG. 1 or may receive cash or credits or other inputs such as clear wager in the form, for example, of physical items as defined above or deal to trigger a card release. Input device 430 or output device 420, for example, via a display (not shown) may likewise represent a denomination indicator for cash or other wager via physical item.

FIG. 3, as attached, consistent with FIGS. 1 and 2 hereof, is a sample, being only a sample of numerous and other related variations of game and house rules (as mentioned in the above), all of which are within the scope of the present invention. Pair of queens 300 and two card hand 6, 3 310 are representative of back and fore hands or Hi and Lo hands as described herein. As described in FIG. 3, the game may be played with six to eight decks of cards with a front hand and back hand circular or other shaped wager locations H and L (FIG. 1). The back hand may be required to be a higher ranking than the front—for example, the pair of queens is ranked higher per FIG. 2 than the front hand 6, 3. The rules of two hand placement may not apply to a single hand wager. The game of Pair 9 Poker Plus may contain certain aspects of both poker and baccarat. The game may also be called the Pai Gow poker way of play. The game may be dealt as five cards from a shoe or shuffler with six or eight decks of cards automatically shuffled together or stored in memory in random order in a known manner using standard cards such as deuce through Ace of each of four suits, spades, hearts, diamonds and clubs, to each player, or in the case of a machine, between player and machine.

Each player may make two wagers by placing chips (cash or credit) in the form, for example, of physical items in a betting, for example, a circular location for receiving the form of physical items or electronically in a virtual or displayed circular location. If a game is played for fun, the players may accumulate a score equivalent to their game play and wagering. Players have the option to wager the back (Hi) or front (Lo) hand of a single bet. Players then evaluate their hand and must discard one card in discard (FIG. 1). If there is a failure to discard, the hand becomes automatically a foul hand. The betting structures are, for example, 1-3, 2-4 and 4-8 or near equal wagers on front or back two card hands are allowed. As described above, a betting structure for allocating a place bet between back and fore hands may be predetermined so that no one can, for example, per house rules, make the ratio 100 to 1 on their best versus worst ranking hand per FIG. 2. Over wagering of hands may not be permitted by house rules under such a betting structure. Players with single wagers may be allowed to bet the house or machine limit on front or back hand. A player evaluates the hand and makes a decision of what to do. Players may be required to discard one card then set their hands into two hands, one front and one back, of two cards each. The single wager player must set his choice of one hand, either front hand or back hand to play or both hands. The dealer or machine using artificial intelligence may then pick up any non-wagered hand and place those cards in a discard rack (or memory in the case of a machine). After discard, players set or select their front and back two card hands. The back hand may be required to be equal to or higher than the ranking of the front hand. Rules of two hand betting or scoring may apply only to both hand wagers. Single wagers need not comply with house two hand rules. All such wagers described above may be in the form of one or more or fractional physical items if the casino rules permit. When all hands are set, the dealer may turn all cards face up (or in the case of a machine, the machine hand or hands may be displayed). The dealer (or machine) evaluates the hands using artificial intelligence if the dealer is an intelligent device and decides which card to discard and sets the dealer or machine back and fore hands based on the house (machine coded instructions) way of playing. Pair 9 Poker Plus is preferably played in pairs (poker way) and points (counts of points by baccarat scoring) only (but may be played in hands of three cards, for example, in an alternative embodiment).

The dealer or machine exposes all player hands and compares the dealer hand to the player hand or hands via the dealer's back hand and front hand declaration and those of the players—back is compared to back and front to front. If the player's front hand beats the dealer's front hand, the player may receive even money for their bet and win. If a machine, the dealer uses artificial intelligent to make decisions. If the dealer and the player have the same hand, the hand may be a tie or push such that the next hand may determine a win. If the player and dealer tie on either the front or back hand, the dealer may win on point copies (tie values). Otherwise, the hand is a push. Each hand is ranked from high to low with a pair of aces being the highest of all ranked hands per, for example, FIG. 2. In the absence of a pair, hands may be ranked according to their combined value where an Ace is one point, a K, Q, J or 10 are zero points and 2-9 are treated at their value.

While various aspects of the present invention have been described above, it should be understood that they have been presented by way of example and not limitation. It will be apparent to persons skilled in the relevant art(s) that various changes in form and detail can be made therein without departing from the spirit and scope of the present invention. Thus, the present invention should not be limited by any of the above described exemplary aspects, but should be defined only in accordance with the following claims and their equivalents.

In addition, it should be understood that the four figures in the attachments, which highlight the structure, methodology, functionality and advantages of the present invention, are presented for example purposes only. The present invention is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

What I claim is:

1. Apparatus for playing a game comprising a machine, the machine including an output device, a special purpose computer processor for executing instructions regarding game play including an instruction for displaying a virtual five card player hand on the output device responsive to receipt, validation and identification of a player monetary value wager in physical items, each physical item having a monetary value in fractional or whole currency values, an input device for receiving said player monetary value wager to establish a credit value in physical items, the special purpose computer processor for validating said player monetary value wager as the credit value toward game play in physical items and then for receiving a player command to the special purpose computer processor for discarding one of the displayed five cards of the virtual five card player hand, the input device for further receiving a further command for allocating two of the remaining four cards of the displayed, virtual five card player hand as a first player hand for play and the other two of the remaining four cards as a second player hand for play, a memory coupled to the special purpose computer processor for storing a virtual five card machine hand and a machine selection of a one card discard and first and second two card hands for play of the machine via artificial intelligence, game rules of play being stored in the memory, the special purpose computer processor for selecting the one card discard of the machine and for calculating, determining and outputting the first and second two card hand choices of the machine via artificial intelligence; and the output device for displaying a player's virtual first and second two card hands for play, the special purpose computer processor determining which of the first two card hands for play of the machine and of the player has a higher ranking closest to a pair of aces, determining which of the second two card hands for play of the machine and of the player has a higher ranking closest to a nine point value where the tens digit is not counted, and causing said apparatus for playing the game to provide a payout in physical items via the output device based on the higher ranking of one of the first and second hands for play of the machine and of the player.

2. The apparatus of claim 1 further comprising a communications interface for communicating with a remote special purpose computer processor, the remote special purpose computer processor making the machine selection of discard and first and second two card hands for play via artificial intelligence of the machine, the machine selected first and second hands for play for comparison with the respective player first or second two card hands for play.

3. The apparatus of claim 1 further comprising the output device, responsive to a comparison of virtual player and machine two card hands for play by the special purpose computer processor, rewarding a player with one of a monetary reward in one or more physical items or fractional physical items.

4. The apparatus of claim 1 further comprising the special purpose computer processor calculating a tie between one of the machine first hand for play and the player first hand for play or the machine second hand for play and the player second hand for play, the special purpose computer processor holding a wager in physical items in memory and outputting a further virtual five card machine hand and a further virtual five card player hand for play.

5. A computer program product for implementing non-transitory instruction logic for a card game for use in constructing a machine, the machine including a special purpose computer processor for playing the card game, the computer program product comprising first computer logic for causing a display of a virtual five card player hand upon receipt and validation of a player monetary value in physical items via an input device and establishing an identified credit in physical items toward game play as a wager, second computer logic for receiving a player selection of a card for discard of the virtual five card player hand and for receiving a player selection of a first two card hand for play and a second two card hand for play from the remaining four cards of the virtual five card player hand after the player selection of the card for discard, third computer logic for selecting, assembling and storing a virtual five card machine hand for play using artificial intelligence and including selecting a first two card machine hand for play and a second two card machine hand for play from the virtual five card machine hand after selecting a card for discard per the third machine computer logic; fourth computer logic for determining which of the first machine two card hand for play and the first player two card hand for play has a higher ranking closest to a pair of aces and for determining which of the second machine two card hand for play and the second player two card hand for play has a higher ranking closest to a nine point value where the tens digit is not counted; and fifth computer logic for determining a winner of a reward in physical items between the machine comprising the special purpose computer processor and the player for the first or second two card hands for play by rules of poker and baccarat scoring respectively and causing the special purpose computer processor to provide a payout in physical items to the player when the player has a higher ranking first or second player two card hand for play.

6. The computer program product of claim 5 wherein said first computer logic causes display of a virtual five card player hand responsive to the special purpose processor having said first computer logic, the special purpose processor using a random selection of five cards from a randomly ordered plurality of between five and eight decks of fifty-two cards.

7. The computer program product of claim 5 wherein said fifth computer logic determines a tie in ranking between the first and second two card hands for play of the machine and of the player and, responsive to the tie determination, causes a new deal of virtual five card hands for play of the machine and of the player.

8. A method of playing a card game on a computer implemented machine with a plurality of decks of cards in random order comprising dealing a five card hand to a player responsive to receipt of a player wager via an input device of the computer implemented machine in one or more physical items or fractional physical items, validation of receipt and establishment of credit toward game play in physical items, receiving a single card discard choice from the player and receiving selections by the player of first and second two card hands for play from the remaining four cards of the dealt five card hand via the input device of the computer implemented machine, the selections by the player for comparison with one of a virtual dealer and a computer implemented machine selection of a single card discard choice and first and second two card hands for play using artificial intelligence and card game rule memory, the computer implanted machine comprising a special purpose computer processor programmed for playing the card game including making the computer implemented machine selection of the first and second two card hands and the single card discard choice using artificial intelligence, where the first two card hand of any of the virtual dealer, the computer implemented machine or the player is evaluated for determining which of the first two card hands of the player, the computer implemented machine and the virtual dealer has a higher ranking closest to a pair of aces and for determining which of the second two card hands of any of the virtual dealer, the computer implemented machine or the player has a highest ranking closest to a nine point value, where the tens digit is not counted, the cards valued 2 through 9 are valued at their face value in the point ranking, the units digit of the sum of the two cards of the second hand being counted, and causing the computer implemented machine to provide a payout in physical units to the player when one of the first and second player two card hands has the highest ranking.

9. The method of playing a card game as recited in claim 8 wherein, in the event of a tie between one of the first computer implemented machine or virtual dealer card two card hand and the first player two card hand, five card hands are dealt via the computer implemented machine so that computer implemented machine or the virtual dealer may resolve the tie with the player.

10. The method of playing a card game as recited in claim 8 wherein a further card may be purchased after discard for a predetermined value in physical items by a player to obtain a possibly different five card hand.

11. The method of playing a card game as recited in claim 8 wherein wagering comprises placing an initial bet, the initial bet being allocated, upon the dealing of a five card player hand, among a bonus bet, a first hand bet, a second hand bet, an insurance bet or an ante, such bets being in physical items accepted and validated to establish a monetary credit.

12. The method of playing a card game as recited in claim 11 wherein wagering by a player is between a house minimum bet and a house maximum bet value in physical items.

13. The method of playing a card game as recited in claim 8 wherein ranking of player and machine first two card hands comprises: first rank, a pair of aces; second rank, a pair of kings; third rank, a pair of queens; fourth rank, a pair of jacks; fifth rank, a pair of tens; sixth rank, a pair of nines; seventh rank, a pair of eights; and eighth rank, a pair of sevens.

14. The method of playing a card game as recited in claim 11 wherein an insurance bet placed before a five card hand is dealt or displayed to a player cannot be greater than an initial bet, the bets being in the form of physical items.

15. The method of playing a card game as recited in claim 14, the insurance bet in physical items comprising receiving a bet on receiving a zero point value for the second two card player hand.

16. The method of playing a card game as recited in claim 8 wherein a failure for a player to select a single card discard from the five card player hand comprises a foul hand.

17. The method of playing a card game as recited in claim 8 wherein the card game is played with a 52 card deck with jokers; jokers being valued as a choice of a predetermined range of point values or as a desired card value in deuce through Ace and choice of suit by the player and by the computer implemented machine and the virtual dealer.

18. The method of playing a card game as recited in claim 8 on a mobile telecommunications device for communicating with a remote computer having computer logic for controlling card game house rules, the mobile telecommunications device being equipped with near field communications for communicating with a near field communication transaction terminal associated with the remote computer for accepting and validating wagers in physical items.

19. The method of playing a card game as recited in claim 8 permitting an additional wager after allocating a place bet among first and second two card hands up to a percentage of the allocated place bet, the additional wager and bets being in the form of physical items.

20. The method of playing a card game as recited in claim 19 wherein the additional wager is awarded in physical items at less than the monetary value of the additional wager according to a predetermined percentage less than 50% of the additional wager.

* * * * *